United States Patent [19]

Hudson

[11] 3,999,512

[45] Dec. 28, 1976

[54] ELECTROSTATIC DEVELOPMENT SYSTEM WITH PASSIVE STORAGE CAPACITY

[75] Inventor: Frederick W. Hudson, West Henrietta, N.Y.

[73] Assignee: Xerox Corporation, Stamford, Conn.

[22] Filed: Sept. 25, 1974

[21] Appl. No.: 508,978

[52] U.S. Cl. ..... 118/636; 118/655

[51] Int. Cl.[2] ..... G03G 15/08

[58] Field of Search ... 118/308, 636, 637, DIG. 24; 117/17.5, 16; 355/3 DD; 427/20

[56] References Cited

UNITED STATES PATENTS

| | | | |
|---|---|---|---|
| 3,011,474 | 12/1961 | Ulrich | 427/20 |
| 3,550,555 | 12/1970 | Hudson | 118/637 |
| 3,648,658 | 3/1972 | Weiler | 118/637 |
| 3,662,711 | 5/1972 | Hudson | 118/637 |
| 3,756,192 | 9/1973 | Locklar et al. | 117/17.5 |

*Primary Examiner*—Mervin Stein
*Assistant Examiner*—Douglas Salser

[57] ABSTRACT

The developer storage capacity of a development system for an electrostatic processor is increased by adding a passive reservoir to supplement the system pump. Provision is made for maintaining a more or less continuous flow of developer into and out of the reservoir, including means for feeding developer from the reservoir to the sump whenever the supply of developer within the sump drops below a predetermined level. In a cascade development system, a hopper having a constricted discharge orifice leading to the development zone of the processor is filled to overflowing with developer so that there is a substantialy constant head causing the orifice to meter developer into the development zone at a substantially uniform rate. The reservoir is, in turn, positioned to intercept the overflowing developer and to feed developer into the sump whenever the supply of developer therein drops below the bottom of the reservoir.

15 Claims, 2 Drawing Figures

ELECTROSTATIC DEVELOPMENT SYSTEM WITH PASSIVE STORAGE CAPACITY

BACKGROUND OF THE INVENTION

This invention relates to development systems for electrostatic processors and, more particularly, to methods and means for reducing the routine maintenance required by those systems.

In a conventional electrostatic printing process of the type described in Carlson's U.S. Pat. No. 2,297,691 on "Electrophotography", a uniformly charged photoreceptor is selectively discharged in an image configuration to provide a latent electrostatic image which is then developed through the application of a finely divided, resinous material, called "toner". As is known, that process has enjoyed outstanding commercial success, especially in plain paper copiers and duplicators. Nevertheless, substantial effort and expense are still being devoted to the perfection of the process, including the development step.

The vehicle normally used in electrostatic processors to deliver the toner is a multi-component developer comprising toner particles and relatively coarse "carrier" particles. The toner and carrier (or sometimes carrier coating) are formed from materials which are removed from each other in the triboelectric series, thereby enabling a triboelectric charging process to be employed to induce electrical charges of opposite polarities on the toner and carrier particles. The polarity of the charge for the toner particles is selected to oppose the charge of the latent image so that there are competing electrostatic forces acting on those particles. Specifically, the toner particles at least initially tend to be attracted to the carrier particles, but are subject to being electrostatically stripped therefrom whenever the developer is brought into the immediate proximity of or actual contact with an image bearing photoconductor.

Provision is commonly made in existing development systems for adding additional toner to the developer from time-to-time so that the toner concentration remains at a suitably high level. However, there still is a recurring problem stemming from the limited useful life of available developers — viz., users of electrostatic processors are faced with the messy and time consuming, routine maintenance task of purging the development system of exhausted developer and recharging it with fresh developer. If that is not done on schedule, there is a marked reduction in the quality of the copies produced.

SUMMARY OF THE INVENTION

Accordingly, the primary aim of this invention is to reduce the routine maintenance required by development systems for electrostatic processors. In keeping therewith, an important object is to provide methods and means for prolonging the useful life of multi-component developers.

Even more specifically, an object of this invention is to provide methods and means which not only prolong the useful life of a charge of multi-component developer, but which also aid in cross mixing the toner and carrier components thereof. A more detailed, related object is to provide methods and means for accomplishing that with known multi-component developers.

Another detailed object of the present invention is to provide an improved cascade development system.

To carry out these and other objects of the invention, the developer storage capacity of a development system for an electrostatic processor is increased by adding a passive reservoir to supplement the system sump. Provision is made for maintaining a more or less continuous flow of developer into and out of the reservoir, including means for feeding developer from the reservoir to the sump whenever the supply of developer within the sump drops below a predetermined level. In a cascade development system, a hopper having a constricted discharge orifice leading to the development zone of the processor is filled to overflowing with the developer so that there is a substantially constant head causing the orifice to meter developer into the development zone at a substantially uniform rate. The reservoir is, in turn, positioned to intercept the overflowing developer and to feed developer into the sump whenever the supply of developer therein drops below the bottom of the reservoir.

BRIEF DESCRIPTION OF THE DRAWINGS

Still further objects and advantages of the present invention will become apparent when the following detailed description is read in conjunction with the attached drawings, in which.

DETAILED DESCRIPTION OF THE ILLUSTRATED EMBODIMENT

While the invention is described in some detail hereinafter with reference to a specific embodiment, it is to be understood that there is no desire to limit it to that embodiment. On the contrary, the intent is to cover all modifications, alternatives and equivalents falling within the spirit and scope of the invention as defined by the appended claims.

Figure 1:
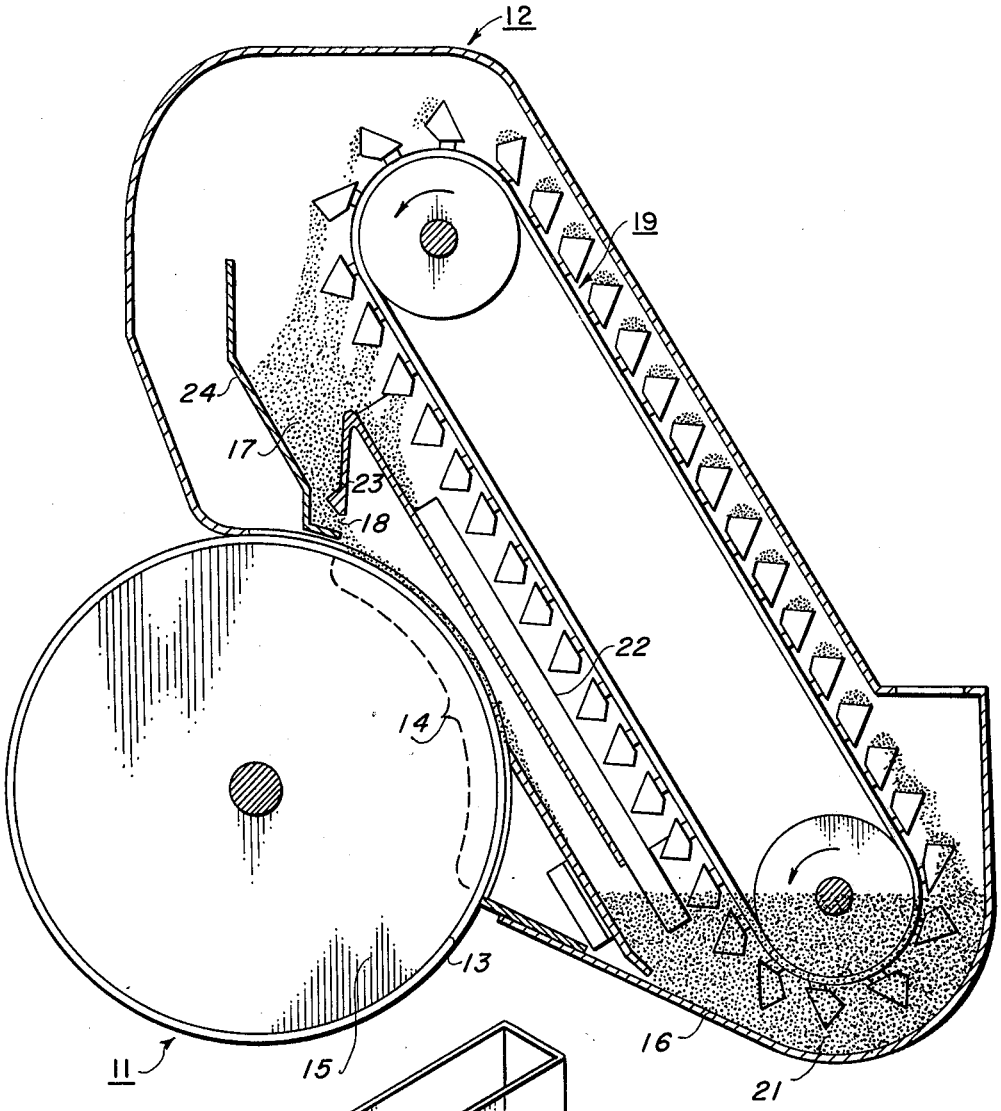
FIG. 1 is a fragmentary, simplified schematic view of an electrostatic processor having a cascade development system embodying the present invention.

Turning now to the drawings, and at this point especially to FIG. 1, to illustrate a typical environment for the invention, there is an electrostatic processor 11 (shown only in relevant part) having a cascade development system 12 for developing latent electrostatic images carried by a photoconductor 13 on the fly — viz., as the photoconductor 13 moves through a development zone 14. In this instance, the photoconductor 13 is coated on the surface of a rotatable drum 15. There are, however, other suitable machine configurations, including one wherein a flexible photoconductor is supported by a belt-like substrate.

To carry out the development process, a multicomponent developer of, say, a commercially available type is brought into contact with the photoconductive surface 13. One of the specific advantages of this invention is that conventional means may be employed for that purpose. For example, as shown, the development system suitably comprises a housing 16 which opens outwardly toward the photoconductor 13 to define the development zone 14, a hopper 17 having a constricted discharge orifice 18 for metering developer into the development zone 14, and a bucket-type conveyor 19 for transporting developer from a sump 21 in the lower reaches of the housing 16 to the hopper 17. Specifically, the conveyor 19 discharges the developer at a point above the hopper 17 which, in turn, is positioned immediately above the development zone 14.

Accordingly, developer circulates in a path which extends upwardly from the sump 21 via the conveyor 19, then downwardly through the discharge orifice 18 of the hopper 17 and then through the development zone 14, and finally back to the sump 21. The orifice 18 is sized to limit the flow of developer into the development zone 14 to a rate which is below the average rate at which developer is delivered to the hopper 17 by the conveyor 19. Therefore, the hopper 17 fills to overflowing after a period of operation, whereby a substantially constant head of developer is then maintained within the hopper 17, thereby causing the orifice 18 to meter developer into the development zone 14 at a generally uniform rate. Latent images carried by the photoconductive surface 13 are, of course, developed because the developer cascades along that surface as it drops through the development zone 14 under the influence of gravity.

In accordance with the present invention, a portion of the charge of developer for the development system 12 is passively stored in a reservoir 22 which, in turn, automatically feeds developer into the sump 21 whenever the supply of developer within the sump 21 drops below a predetermined level. Developer stored within the reservoir 22 is subjected to considerably less working than developer elsewhere in the system (i.e., it is "passively" stored). Thus, the reservoir 22 not only increases the quantity of developer that can be included in the charge, but also prolongs the useful life of the charge.

There is, of course, a tendency for a powder cloud to form in the area of the conveyor 19 and the sump 21. In this instance, however, the reservoir 22 is a physical barrier which more or less isolates the development zone 14 from that area. Thus, the reservoir 22 has the additional advantage of suppressing powder cloud contamination of the development zone 14.

To carry out the invention, means are provided for maintaining a more or less continuous flow of developer into and out of the reservoir 22 so that the developer tends to age reasonably uniformly. To accomplish that, as illustrated, the reservoir 22 is open at its top and bottom and is vertically supported to extend from a position below and to the rear of the hopper 17 to a position within the sump 21. Additionally, the rear wall 23 of the hopper 17 is lower than the forward wall 24 so that the overflow or consequently, the diverted developer from the hopper 17 tends to spill over the rear wall 23 into the top of the reservoir 22. The opening in the bottom of the reservoir 22, on the other hand, ensures that the supply of developer within the sump 21 remains at or near the level of that opening.

Figure 2:
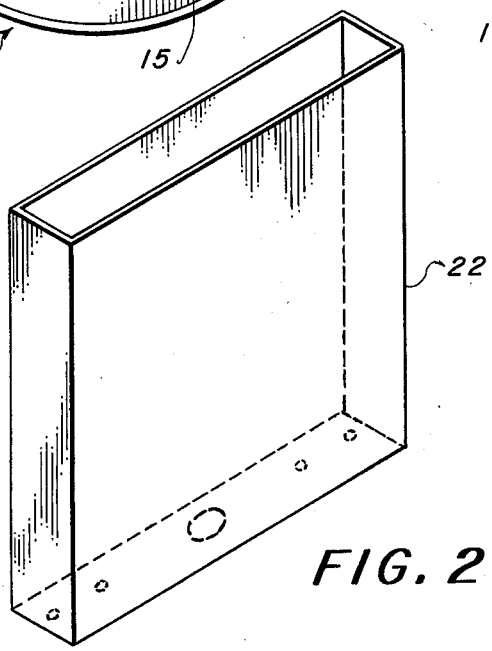
FIG. 2 is a perspective view of the reservoir included in the development system of FIG. 1 in accordance with this invention.

Referring to FIG. 2, cross mixing of the developer flowing through the reservoir 22 may be achieved by providing a relatively wide mouth or opening at the top to accomodate the incoming flow and a relatively narrow centrally located throat or opening at the bottom to accomodate the outgoing flow. Additionally, vanes or other provision (not shown) may be included in the reservoir 22 to laterally deflect or redirect the developer flowing therethrough to further enhance the cross mixing action. Preferably, the reservoir 22 is generally rectangular to maximize its storage capacity. In that event, there desirably are relatively small openings in the bottom of the reservoir on either side of the centrally located discharge opening to relieve any pockets of non-flowing or "dead" developer which might otherwise collect along the outboard edges of the reservoir 22. Alternatively, the reservoir 22 may have a funnel-like or hopper-like configuration to force the developer flowing therethrough inwardly toward the central discharge opening.

CONCLUSION

In view of the foregoing, it will be apparent that provision has been made for prolonging the useful life of the developer charge conventionally used in the development system for an electrostatic processor. While the invention has been described in terms of providing an off-line (i.e., out of the primary flow path) passive storage capacity for a cascade development system, it will be evident that the basic concept of adding passive storage to a development system is not so limited. For example, in a magnetic brush development system, it might be more desirable to have the passive storage capacity on-line to intercept the developer returning from the development zone to the sump. Additionally, of course, it will be understood, that the provision made in accordance with this invention to prolong the useful life of the developer charge may also be used to achieve developer cross mixing.

What is claimed is:

1. In a development system of the type that is charged with a multi-component developer to develop latent electrostatic images carried by a photoconductor; said system including a sump for storing a supply of developer, and means for feeding developer from said sump into contact with said photoconductor; the improvement comprising means for passively storing a portion of said developer charge, said means responsive to a drop in the supply of developer below a preselected level to control the flow of developer out of said storage means during operation of said development system to maintain the supply of developer within said sump at a predetermined level.

2. The development system of claim 1 wherein said storage means includes a reservoir having an open bottom disposed in said sump, whereby developer is fed from said reservoir to said sump whenever the supply of developer within the sump drops below the bottom of said reservoir.

3. The development system of claim 1 wherein said storage means includes a reservoir having an open top for accomodating an incoming flow of developer and an open bottom for accomodating an outgoing flow of developer, the opening in the bottom of said reservoir being narrower than the opening in the top, whereby developer flowing through said reservoir is cross mixed.

4. The development system of claim 3 wherein the bottom of said reservoir is disposed in said sump, whereby developer is fed from said reservoir to said sump whenever the supply of developer with said sump drops below the bottom of said reservoir.

5. The development system of claim 1 wherein said storage means includes means for cross mixing developer flowing therethrough.

6. A cascade development system for developing latent electrostatic images carried by a photoconductor as said photoconductor moves through a development zone, said development system comprising the combination of a sump for storing a supply of developer;

a hopper disposed above said development zone, said hopper having a constricted discharge orifice leading to said development zone;

means for transporting developer from said sump to said hopper at a rate sufficient to fill said hopper to overflowing, whereby a substantially constant head of developer is maintained in said hopper, thereby causing said orifice to meter developer into said development zone at a generally uniform rate; and storage means for passively storing developer overflowing from said hopper and for feeding developer into said sump whenever the supply of developer within said sump drops below a predetermined level.

7. The development system of claim 6 wherein said storage means comprises a reservoir having an open top positioned to intercept developer overflowing from said hopper and an open bottom disposed in said sump, whereby developer is fed from said reservoir to said sump whenever the supply of developer within said sump drops below the bottom of said reservoir.

8. The development system of claim 7 wherein said reservoir cross mixes the developer flowing therethrough.

9. The development system of claim 7 wherein the opening in the bottom of said reservoir is centrally located and is narrower than the opening in the top, whereby developer flowing through said reservoir tends to be cross mixed.

10. The development system of claim 9 wherein the bottom of said reservoir defines relatively small discharge openings disposed on opposite sides of a relatively large centrally located discharge opening, whereby the large opening promotes cross mixing of developer flowing through the reservoir and the small openings relieve any tendency for pockets of non-flowing developer to collect in said reservoir.

11. A development system for developing latent electrostatic images carried by an imaging surface as said surface moves through a development zone comprising:

1. a sump for storing a first volume of developer,
2. a developer conveyor,
3. means for continuously moving said conveyor through said first volume to concurrently blend said volume and transport a portion thereof along a path toward said development zone, and
4. storage means for holding a second volume of said developer separate from said first volume and out of contact with said conveyor, said storage means responding to the drop in said first volume below a preselected level to permit exit of a portion of said second volume into said sump.

12. The combination recited in claim 11 wherein said conveyor comprises an endless member, said member having a plurality of bucket-like containers carried thereby.

13. The combination recited in claim 11 wherein said storage means comprises a reservoir having a first opening at the top thereof and a second opening at the bottom thereof, the bottom of said reservoir being disposed in said sump, whereby developer is fed from said reservoir to said sump whenever said first volume drops below the bottom of said reservoir.

14. In a developer for developing latent electrostatic images carried by an imaging surface as said surface moves through a development zone and further including a sump for storing a first volume of developer, and means for transporting said developer along a path from said sump to said zone and back to said sump, the improvement comprising storage means for holding a second volume of developer apart from said first volume, said storage means being responsive to the drop in the level of said first volume to release a portion of said second volume into said sump.

15. The combination recited in claim 14 wherein said storage means comprises a reservoir having a first opening at the top thereof and a second opening at the bottom thereof, the bottom of said reservoir being disposed in said sump, whereby developer is fed from said reservoir to said sump whenever said first volume drops below the bottom of said reservoir.

* * * * *